US005915849A

United States Patent [19]

Dongo

[11] Patent Number: 5,915,849

[45] Date of Patent: Jun. 29, 1999

[54] SELECTABLE HYDROTHERAPY JET SYSTEM

[75] Inventor: Paul A. Dongo, Camarillo, Calif.

[73] Assignee: B&S Plastics, Inc., Oxnard, Calif.

[21] Appl. No.: 08/975,893

[22] Filed: Nov. 20, 1997

[51] Int. Cl.[6] ..... A61H 33/04

[52] U.S. Cl. ..... 4/541.6; 4/541.4; 4/541.1; 4/492; 4/541.3

[58] Field of Search ..... 4/541.1–541.6, 4/567, 492; 239/391, 392, 394, 398, 434, 442, 538, 428.5; 261/76, 78.1, DIG. 39, DIG. 65; 417/151, 198

[56] References Cited

U.S. PATENT DOCUMENTS

| | | | |
|---|---|---|---|
| 3,704,831 | 12/1972 | Clark | 239/394 |
| 4,903,897 | 2/1990 | Hayes | 239/394 |
| 5,172,866 | 12/1992 | Ward | 239/446 |
| 5,245,714 | 9/1993 | Haraga et al. | 4/492 |
| 5,271,561 | 12/1993 | Tobias et al. | 4/541.6 |
| 5,316,216 | 5/1994 | Cammack et al. | 239/71 |
| 5,742,953 | 4/1998 | Loizeaux et al. | 4/541.6 |
| 5,862,543 | 1/1999 | Reynoso et al. | 4/541.6 |

FOREIGN PATENT DOCUMENTS

| | | | |
|---|---|---|---|
| 154677 | 1/1954 | Australia | 239/394 |

*Primary Examiner*—Henry J. Recla
*Assistant Examiner*—Tuan Nguyen
*Attorney, Agent, or Firm*—Koppel & Jacobs

[57] ABSTRACT

A hydrotherapy jet system has a rotatable multi-nozzle unit containing a series of individual nozzles that are selectable, while water is flowing through the system, to present different flow affect. Water flows into a jet body where it is diverted into an into a passageway that is non-coaxial with the jet body. Within the passageway is a venturi which aerates the water stream. Leaving the venturi, the water enters the multi-nozzle unit, flows through the nozzle in line with the passageway, exiting the jet body into a spa or tub. The nozzles are selectable by the rotation of the nozzle carrier to provide different flow affects to the user.

21 Claims, 6 Drawing Sheets

SELECTABLE HYDROTHERAPY JET SYSTEM

BACKGROUND OF THE INVENTION

1. Field of the Invention

The invention relates to a hydrotherapy jet system which contains a series of different nozzles which are selectable while water is flowing through the system.

2. Description of the Related Art

Various hydrotherapy jets have been developed in the past, for use in spas, hot tubs and bath tubs, that discharge an aerated stream of water through a variety of discharge nozzles. Such jets have been found to produce a pleasing massaging effect for many users, and have become quite popular.

Hydrotherapy jets are commercially available in a wide variety of nozzle designs. The various designs provide different flow characteristics which result in different massage affect bring experienced by the body. In the design and manufacture of single or multi-user spas or tubs, it is common to use a variety of different jet nozzles around the tub to provide a variety of massaging effect. Thus, a user who wants a specific massage affect simply moves their body, or body part, to that jet location. However, it is often found that the jet having the desired effect is not at the preferred location. Interchangeable jets systems have therefore been designed which allow the user to change jets, placing the desired jet at the desired location.

In one such system, the existing jet is unscrewed, removed from its housing, and replaced with a second jet which in turn is screwed back into the housing. See Waterway Plastics, Inc., "1997 Product Catalog," page 6. While this is an improvement over a fixed jet system, offering user flexibility, the exchange of jets requires that the spa or tub be turned off, stopping the flow of water and halting the spa's use. In addition, if the exchange is not properly done, damage can result to the jet itself or, more importantly, to the housing containing the jet.

In an second approach, rather than exchanging the entire jet body, only the nozzle section is exchanged. This is achieved by the addition of a series of snap fit prongs mounted to the nozzle which are press fit into the jet body and clipped into place. The nozzle is removed by firmly pulling on the nozzle face to release the prongs. See Waterway "1997 Product Catalog" mentioned above, page 8. While this is an improvement over removing the entire jet body, as damage to the jet housing is less likely to occur, it too suffers from many of the same problems. For example, the exchange still requires the spa system to be turned off, stopping the flow of water and halting the spas use, and while damage to the housing is less likely there is still the potential for damage to other parts of the jet system as a result of the installation and removal.

SUMMARY OF THE INVENTION

The present invention seeks to provide a selectable hydrotherapy jet system that is simple in design, can be easily fabricated using conventional molding techniques, and provides easy user operated controls for the selection of different jet nozzles to provide different massaging effect. The system has the added advantage that the selection can be accomplished while the spa or tub is in operation and without potential damage to the system or its components.

The system consists of a jet body containing a jet carrier having a series of different nozzles that can be selected by the user. The jet body is mounted within a jet housing. Water from a spa or tub pump system is fed through a series of pipes to the jet housing which in turn provides the water to the jet body. Water entering the jet body flows through a passageway in the jet which is non-coaxial with the jet body. A venturi is located within the passageway and creates an aerated water stream. The water leaving the venturi exits the jet body through one of the jet nozzles. A desired nozzle is selected by rotating the nozzle carrier, aligning the desired nozzle with the passageway, this can be done while the spa system is still operating. Thus, while water is flowing through the jet body a user simply rotates the nozzle carrier from one nozzle to another without shutting down the system.

In an alternate configuration, the system includes groups of nozzles with the nozzles within each group operating simultaneously when that group is selected. A series of parallel passageways, each containing a venturi, discharge aerated water into the respective nozzles of the selected group. Thus, a user of the system would experience a flow from two or more jets operating simultaneously. In addition, a user can select from one of several nozzle groups by the rotating the nozzle carrier.

These and other further features and advantages of the invention will be apparent to those skilled in the art from the following detailed description, taken together with the accompanying drawings, in which:

DETAILED DESCRIPTION OF THE INVENTION

The invention relates to selectable hydrotherapy jet system in which a user can select from a variety of jet nozzles, providing different massage affects, while the spa system is in operation. The user simply rotates a nozzle carrier, ratcheting into place a nozzle of choice. Not only can this be accomplished while the system is in operation, but can be done without fear of damage to the nozzle or jet body caused by their installation or removal.

Figure 1:
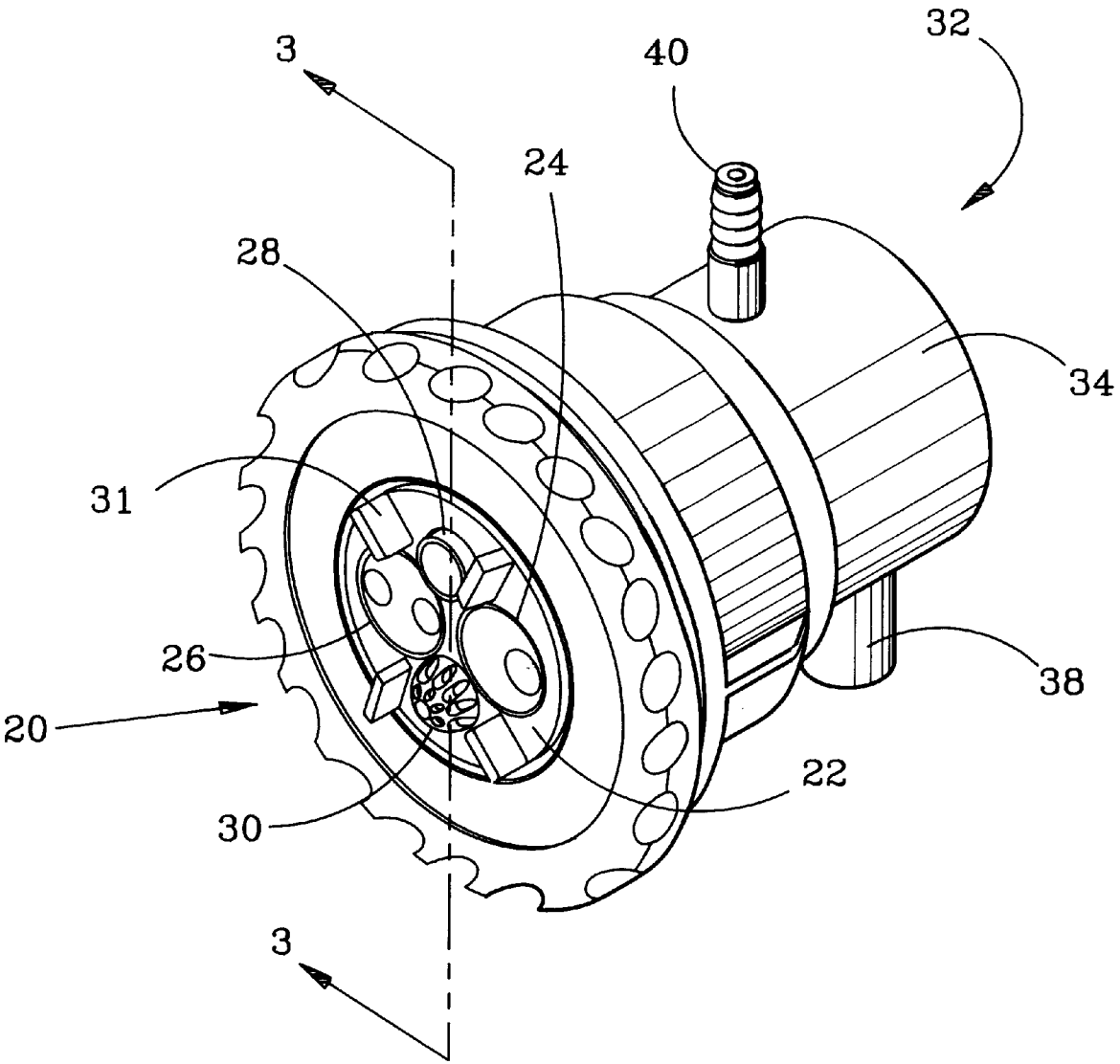
FIG. 1 is a perspective view of a selectable hydrotherapy jet system and mounting housing in accordance with the invention.

A selectable hydrotherapy jet system 20 constructed in accordance with the invention is shown in FIG. 1. Jet 20 contains a nozzle carrier 22 which houses a series of selectable nozzles, for example; a whirly eyeball 24; a pulsator eyeball 26; a minijet eyeball 28; and a soft jet 30. Provided within the face of carrier 22 are a series of finger tabs 31 which are used to rotate carrier 22 to select a nozzle of choice. Jet 20 is enclosed within a housing 32 that consists of a rear body portion 34 that mates with a front body portion 36 (not shown). The rear body portion 34 includes water and air conduits 38 and 40 that allow for a flow of water and air into jet 20, transverse to its axis.

Figure 2:
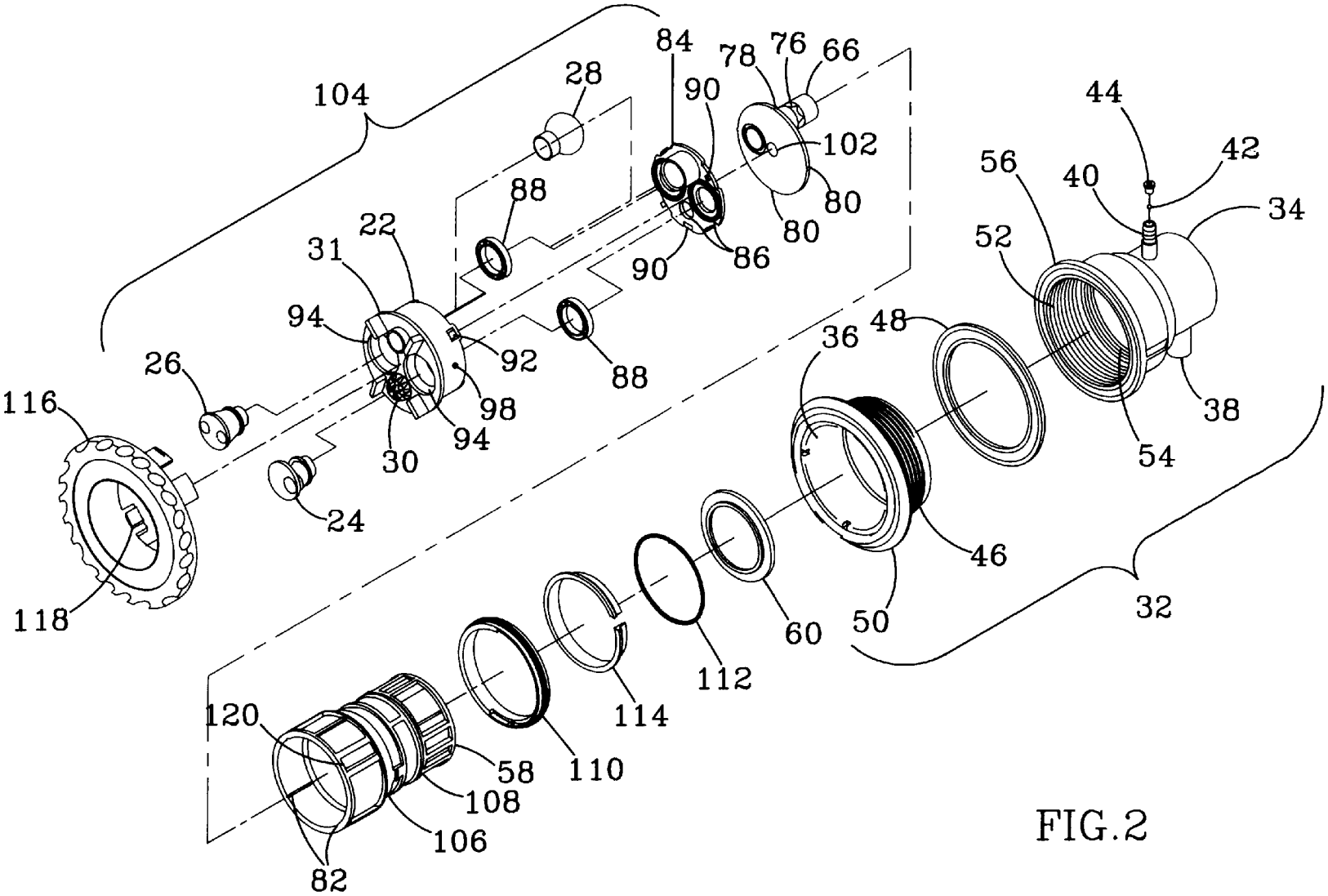
FIG. 2 is an exploded perspective view of the selectable hydrotherapy jet system and mounting housing shown in FIG. 1.

As shown in FIG. 2, internally within air conduit 40 is a check valve used to prevent water from back flowing into an air supply system. The check valve contains a check valve ball 42 which is held in place by a check valve ball retainer 44. In the event that water back flows into the air system, ball 42 is forced against retainer 44, sealing off air conduit 40, preventing water from further flowing into the air system.

Front body portion 36 includes an exterior threading 46, with a gasket 48 adjacent to a front flange 50 located at the forward end of threading 46. Rear body portion 34 includes an interior threading 52 and 54 and a forward flange 56. The jet system is held in place, protruding through an opening in the wall of the spa or tub, by sandwiching the spa or tub wall surrounding the opening between gasket 48 and flange 56 and by threading external threads 46 into internal threads 52 and tightening.

Figure 3:
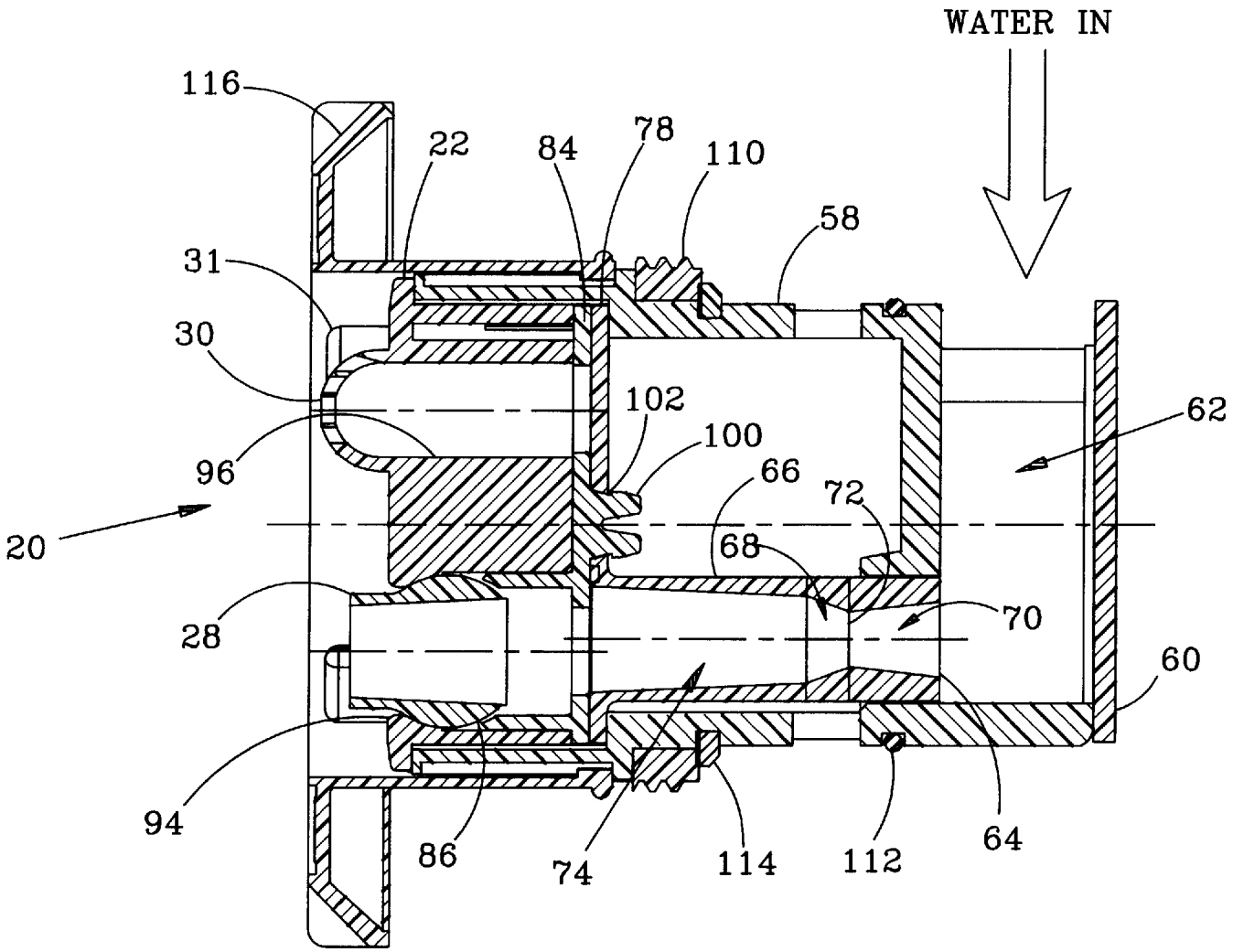
FIG. 3 is a sectional view of a selectable hydrotherapy jet system, without mounting housing, in accordance with the invention taken across section lines 3—3.

Mounted within housing 32 is jet 20 which further contains a diverter 58 that is rotatable to adjust the volume of water discharge by the jet system (see also FIG. 3) Diverter 58 can be rotated through an arc of about 180° to adjust the volume of water discharged from jet 20. Mated to the aft end of diverter 58 is a diverter plate 60 which forms a tapering side wall channel 62 whose axis is parallel to that of water conduit 38. The walls of channel 62 taper to an exit port 64 whose axis is normal to that of channel 62 and non-coaxial with that of diverter 58. Attached to exit port 64, at its first end, is an air water injector 66 which houses a venturi 68. Venturi 68 has a forward section 70 that tapers down to its smallest diameter at a throat 72. Aft of throat 72 venturi 68 expands in diameter forming an aft section 74. Aft of throat 72, in section 74, are located a series of air openings 76 used to aerate water flowing through venturi 68. Water flowing through forward section 70 is gradually constricted, causing it to decrease in pressure and increase in flow rate, until reaching a maximum constriction at throat 72. After passing throat 72, the water enters section 74 where the flow stream is expanded, increasing the fluid pressure and decreasing its flow rate. The differential in pressure created after throat 72 results in a low pressure area, which corresponds to air openings 76, causing an inflow of air into the water flow stream, aerating it. The design of venturi 68 is determined techniques know to those skilled in the art based on the geometric constraints of the system and the pressure and flow rate of the flow stream entering into the system.

Aft section 74 of venturi 68 is attached, preferably by molding, to an end plate 78 which contains a series of locking tab 80 located around its perimeter and which interface with a series of locking slots 82 located on the inside surface of diverter 58.

Located forward of end plate 78 is a nozzle support plate 84 which contains a series of nozzle mounts 86 which vary in structure and size depending upon the individual nozzle utilized. In a preferred configuration, jet 20 contains a series of four nozzles; a whirly eyeball 24, a pulsator eyeball 26, a mini-jet eyeball 28, and a soft jet 30. Whirly 24 and pulsator 26 both require the use of a rotary bearing 88, preferably a ball bearing system. An inner race of bearing 88 mates with a sleeve located at the aft end of whirly 24 and pulsator 26. The sleeve contains a tab which holds bearing 88 in place. An outer race on baring 88 is mounted into support plate 84 at the appropriate nozzle mount. When assembled, baring 88 permits both whirly 24 and pulsator 26 to rotate in a circular fashion when subjected to water flow, generating a circular, pulsating effect. Mini jet 28 has a rounded aft end which mates with a concave nozzle mount 86 and is capable of being repositioned to change the direction of the water flow.

Located around the perimeter of support plate 84 are located a series of locking tabs 90 which lock into a locking slot 92 on a nozzle carrier 22. Carrier 22 contains a series of ports 94, which are in a one-to-one correspondence with the number of nozzles utilized. The ports can be a through hole or can contain a degree of blockage to modify the fluid flow stream. For example, in a preferred configuration carrier 22 has molded into one its ports 94, soft jet 30, which contains a series of bores. The total cross sectional area of the bores is preferably greater than or equal to that of throat 72. In an preferred configuration jet 30 is a hemispherical dome shape having two concentric rings of bores, seventeen in total, surrounding a center, larger diameter bore. The bores are preferably coaxial with each other and with injector 66. However, depending upon the size of jet 30, the bores forming the outer ring can be oval to allow for a smooth water flow, having an taper of approximately 16°. Molded internally within soft jet 30 is a fluid passageway 96 that mates with the jets corresponding nozzle mount 86 on nozzle support plate 84.

Provided within the face of carrier 22 are a series of finger tabs 31 which are used to rotate carrier 22. Located on the outside edge of carrier 22 is a detent 98 which latches into one of the locking slots 82. Located on the back side of nozzle support plate 84 is a clip 100 which clips into a port 102 located approximately in the center of end plate 78. Port 102 is tapered forming a surface upon which clip 100 slides, permitting rotation of carrier 22. As carrier 22 is rotated, at approximately 90° intervals, detent 98 latches into a locking slot 82, aligning one of the nozzle with injector 66, also preventing inadvertent rotation of carrier 22.

In assembly, Whirly 24 and pulsator 26 receive their individual bearings 88 which are fitted onto their aft end sleeves and in turn fitted into their respective nozzle mounts 86. Mini jet 28 is then aligned with its nozzle mount 86 and carrier 22 is aligned with its respective ports 94 corresponding to their individual nozzles. Carrier 22 is then fastened to plate 84 held in place by the locking of tabs 90 into slots 92, thus forming a multi nozzle unit 104. Unit 104 is then fastened to plate 78 by fastening clip 100 into port 102. Injector 66 is then inserted into exit port 64 of diverter 58, preferably held in place by the use of an adhesive. Attached to the aft end of diverter 58 is diverter plate 60, which is also preferably held in place by an adhesive.

Located around the outside of diverter 58 are a series of axial grooves 106 and 108, into which a locking thread ring 110 and an O-ring 112 are respectively seated. Locking ring 110 is held in place by the use of a snap ring 114.

Attached to the forward of diverter 58 is an escutcheon 116 which is held in place by a series of locking tabs 118 which mate with a series of locking slots 120 located around the perimeter of diverter 58.

Diverter 58 is mated with housing 32 by the threading ring 110 into interior threads 54. Diverter 58 is threaded into housing 32 by the rotation of escutcheon 116 until diverter 58 is affixed tightly in place. Once affixed in place, diverter 58 can be rotated by escutcheon 116 through an arc of about 180° to adjust the volume of water discharged from jet 20. When diverter 58 is positioned at one end of its rotational limit, water flowing through conduit 38 flows directly into channel 62 and is diverted through exit port 64 into injector 66. When diverter 58 is positioned at its other rotational limit, water conduit 38 and channel 62 are not in alignment, prohibiting water to flow into system 20. Intermediate levels of water flow can be established by rotating the diverter to an intermediate position between the limits of this rotation.

In operation, water from the spa pump system flows through a set of piping into water conduit 38 where it in turn flows into channel 62. Water in channel 62 is diverted into exit port 64 and in turn into injector 66 where it flows into venturi 68. Water entering venturi 68 flows through throat section 72 where it is aerated by the introduction of air from openings 76. Water leaving venturi 68 exits injector 66 and flows into multi nozzle unit 104 where it flows into the nozzle aligned with injector 66, and in turn into the spa or tub. The water enters the spa or tub at a pressure in the range of approximately 55 Kpa to about 110 Kpa and at a flow rate in the range of approximately 50 to 80 liters per minute. A user in the spa or tub may, while the system is in operation, select any nozzle they wish by the simple rotation of finger tab 31 in either a clockwise or counter clockwise direction. The selected jet is held in position by the locking of detent 98 into locking slot 82.

Figure 4:
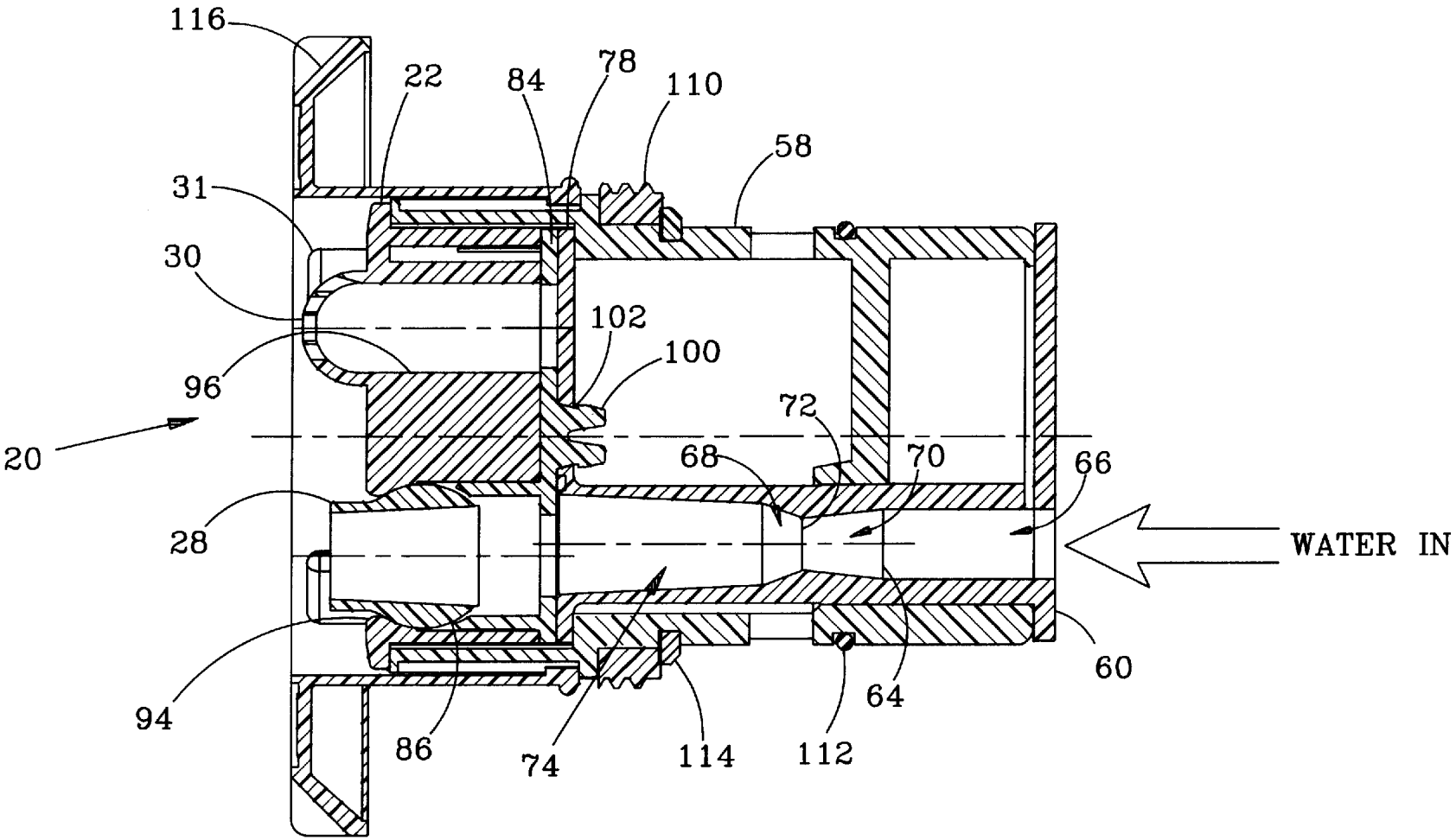
FIG. 4 is a sectional view of an alternate configuration of the selectable hydrotherapy jet system depicting a straight-in, off center flow path, as viewed in the same direction as FIG. 3.

In an alternate configuration of the selectable hydrotherapy jet system, as shown FIG. 4, water received by jet 20 is provided directly to injector 66 rather than having to be diverted into it. This alternate approach results in a higher pressure jet being emitted from system 20, as the flow stream is not subjected to the pressure losses encountered as a result of diverting it into injector 66.

Figure 5:
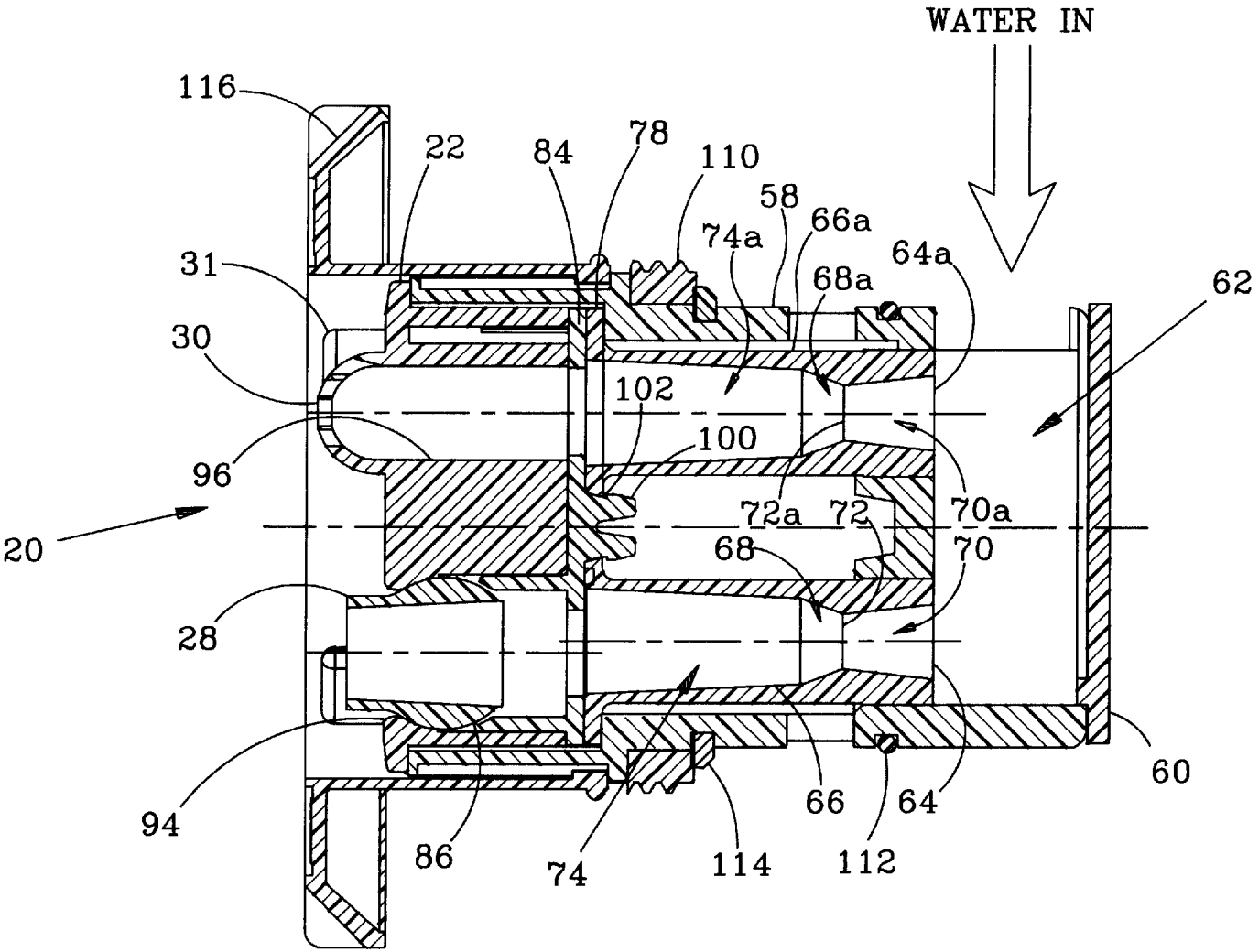
FIG. 5 is a sectional view of an alternate configuration of the selectable hydrotherapy jet system depicting a group of selectable jets with differing frequencies working simultaneously, as viewed in the same direction as FIG. 3.

In a second alternate configuration of the selectable hydrotherapy jet system, as shown in FIG. 5, two or more nozzles are operated simultaneously. In this configuration, a second injector 66*a* also containing a venturi 68*a* is provided. Thus, water flowing into diverter 58 encounters a series of two or more exit ports 64 and 64*a* into which the water is diverted. Like a single injector system, the water flowing through either injector 66 or 66*a* encounters their respective venturi 68 or 68*a* where it is aerated and is provided to one of several selectable nozzles. Thus, a user of the system would experience the flow from two or more jets operating simultaneously. In addition, a user selects from several groups of nozzle combinations by the simple rotation of finger tabs 31.

Figure 6:
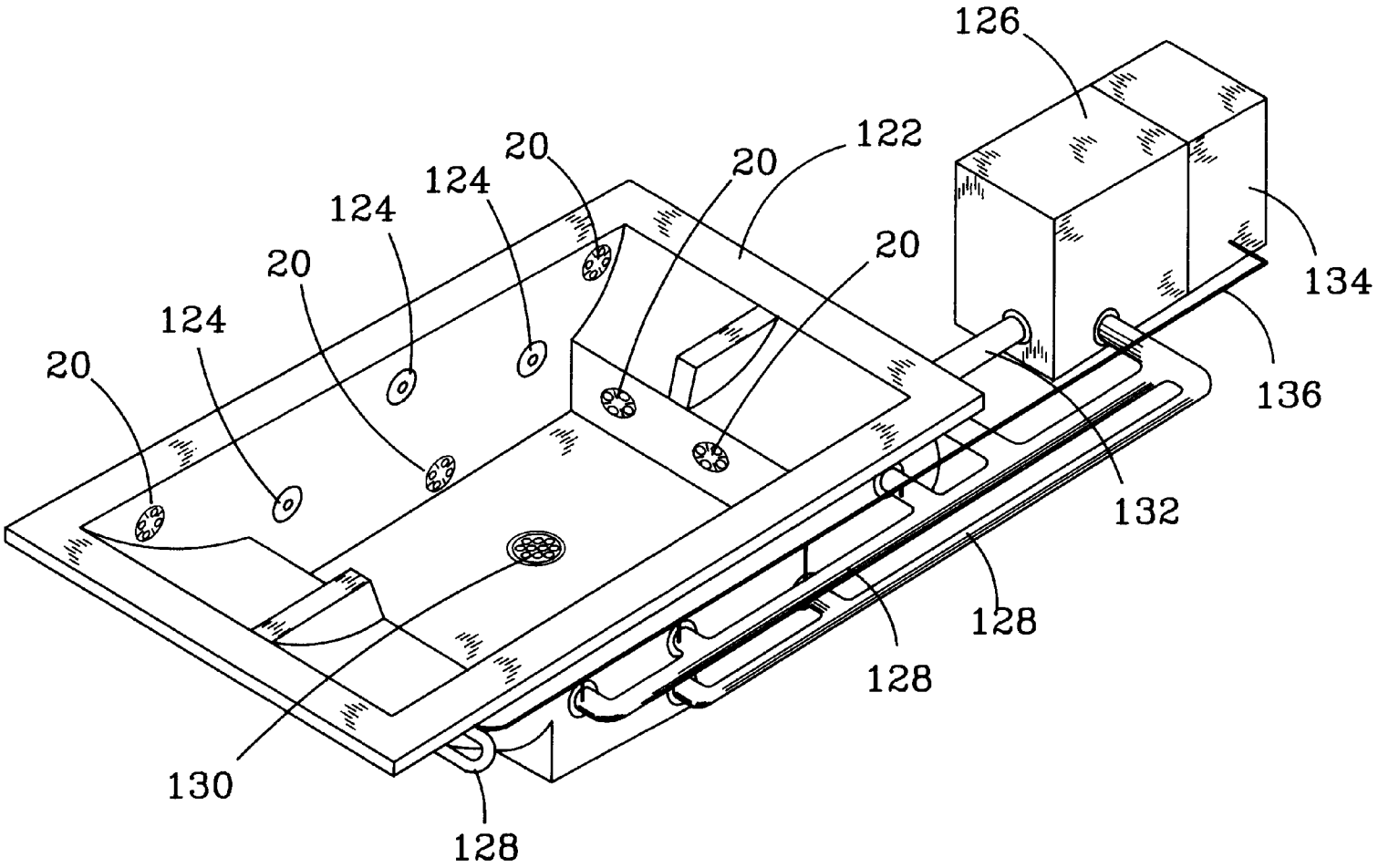
FIG. 6 is a perspective view of the spa system utilizing a series of selectable hydrotherapy jets.

As shown in FIG. 6, multiple jets can be installed in a spa or tube shell 122 with all or some of the jets being a jet 20. The remaining jets can be a variety of prior art single nozzle jets 124. Both types of jets are connected to a water pump system 126, used to circulate the water throughout the spa system, by a series of water conduits 128. Water from shell 122 is provided to pump 126 through a drain 130 which is connected to a return water conduit 132 and in turn to pump 128. Water from pump 128 is provided back to shell 122 by conduit 128, where it flows into jets 20 or 124, as the case may be, and in turn into shell 122, completing the loop. Additionally, an air system 134 can be included that provides air to individual jets 20 and 124, by an air conduit 136, to aerate the water flowing through the jet. System 134 can be pump driven to increase the pressure of the air enter the jets, or the system can be vacuum based in which the venturi located within the jets draw the air into the water flow stream.

Although the present invention has been described in considerable detail with reference to certain preferred configurations thereof, other versions are possible. Therefore, the spirit and scope of the appended claims should not be limited to their preferred versions contained therein.

I claim:

1. A selectable hydrotherapy jet system, comprising:

a jet body having a longitudinal axis;

a water inlet in said body;

a water passageway within said body in the form of a venturi for forming water flowing through said inlet into a jet, said passageway having a longitudinal axis which is non-coaxial with said jet body longitudinal axis; and a movable multi-nozzle carrier attached to said body having a series of outlet nozzles which are selectable to receive the jet produced by said passageway, each of said nozzles when selected producing a different water flow from the body.

2. The system of claim 1, wherein said jet body and passageway axes are parallel.

3. The system of claim 1, wherein said passageway includes an air inlet for aeration of water flowing through said passageway.

4. The system of claim 1, wherein one of said nozzles comprises a plurality of bores whose total cross sectional area is greater then the cross-sectional area of the narrowest portion of said venturi.

5. The system of claim 1, wherein said carrier is rotatably movable so that a desired nozzle can be selected by rotating the carrier to align the desired nozzle with the water passageway.

6. The system of claim 5, wherein said carrier has a detent that fixes a rotational position and maintains the desired nozzle in alignment with the water passageway.

7. The system of claims 5, wherein said carrier has an axis of rotation that is coaxial with the jet body's longitudinal axis.

8. A selectable hydrotherapy jet system, comprising:

a rotatable jet body, having a longitudinal axis, housed within a jet housing;

a water inlet in said body;

a water passageway within said body for forming water flowing through said inlet into a jet, said passageway having a longitudinal axis which is non-coaxial with said jet body longitudinal axis; and a multi-nozzle carrier attached to said body having a series of outlet nozzles which are selectable to receive the jet produced by said passageway, each of said nozzles when selected producing a different water flow from the body, wherein said jet body is rotatable within said housing for altering the flow of water from said housing into said jet body, said jet body being rotatable in one direction to close said water inlet and restrict the flow of water into said jet body, and rotatable in the opposite direction to open said water inlet and increase the flow of water into said jet body.

9. The system of claim 1, wherein said nozzles are selectable while water is flowing through said system.

10. The system of claim 1, wherein at least one nozzle is integrally molded into said carrier with the other nozzles being discrete.

11. A spa system, comprising:

a spa shell that is capable of holding water;

a plurality of selectable multi-nozzle water jets mounted around the spa shell, a water pump system that circulates water throughout said spa by providing water to said jets and receiving water from said spa shell, each jet comprising a plurality of moveably selectable nozzles mounted therein, which are individually selectable independent of each other to be connected to said system.

12. The system of claim 11, wherein said spa further comprises an air system that provides air to aerate water flowing through said jets.

13. The system of claim 11, wherein said multi-nozzle water jet comprises:

a jet body having a longitudinal axis;

a water inlet in said body;

a water passageway within said body for forming water flowing through said inlet into a jet, said passageway having a longitudinal axis which is non-coaxial with said jet body longitudinal axis; and a multi-nozzle carrier attached to said body having a series of outlet nozzles which are selectable to receive the jet produced by said passageway, each of said nozzles when selected producing a different water flow from the body.

14. The system of claim 13, wherein said passageway includes an air inlet for aeration of water flowing through said passageway.

15. The system of claim 14, wherein said passageway forms a venturi.

16. A spa system, comprising:

a spa shell that is capable of holding water;

a plurality of multi-nozzle water jets mounted around the spa shell in which individual nozzles are selectable independent of the other jets; and a water pump system that circulates water throughout said spa by providing water to said jets and receiving water from said spa shell;

wherein each of said multi-nozzle water jets comprise:

a jet body having a longitudinal axis;

a water inlet in said body;

a water passageway within said body for forming water flowing through said inlet into a jet, said passageway having a longitudinal axis which is non-coaxial with said jet body longitudinal axis; and a rotatable multi-nozzle carrier attached to said body having a series of outlet nozzles which are selectable by rotating the carrier to align the desired nozzle with the water passageway to receive the jet produced by said passageway, each of said nozzles when selected producing a different water flow from the body.

17. The system of claim 13, wherein said nozzles are selectable while water is flowing through said system.

18. A jet body, comprising a water passageway with a venturi that provides a jet of water to a one of a series of jet nozzles, mounted within a movable nozzle carrier, that is adjustable from the front of said jet body to move the carrier with respect to said passageway to position different nozzles to receive water flow from said passageway.

19. A selectable hydrotherapy jet system, comprising:

a jet body;

a water inlet in said body;

a water passageway within said body containing a singular venturi for forming water flowing through said inlet into an aerated jet, and a multi-nozzle carrier, attached to said body, comprising a series of outlet nozzles mounted therein which are individually selectable independent of each other to receive the jet produced by said singular venturi, each of said nozzles when selected producing a different water flow from the body.

20. The system of claim 19, wherein said carrier is rotatable so that a desired nozzle can be selected by rotating the carrier to align the desired nozzle with the singular venturi.

21. The system of claim 19, wherein said nozzles are selectable while water is flowing through said system.

* * * * *